United States Patent [19]

Yablonovitch

[11] Patent Number: 5,009,008

[45] Date of Patent: Apr. 23, 1991

[54] THUMB ACTUATOR FOR FOLDING KNIFE

[75] Inventor: Max Yablonovitch, Dollard-des-Ormeaux, Canada

[73] Assignee: Y.B. Technology, Canada

[21] Appl. No.: 421,647

[22] Filed: Oct. 16, 1989

[51] Int. Cl.[5] ..... B26B 3/06; B26B 13/00; B26B 1/00

[52] U.S. Cl. ..... 30/158; 30/258; 30/321

[58] Field of Search ..... 30/88, 155, 157, 158, 30/160, 161, 258, 321

[56] References Cited

U.S. PATENT DOCUMENTS

| | | | |
|---|---|---|---|
| 174,289 | 2/1876 | Peirce . | |
| 280,150 | 6/1883 | Du Bois . | |
| 370,706 | 9/1887 | Kozmann . | |
| 431,584 | 7/1880 | Van Holland . | |
| 568,998 | 10/1896 | Weeks . | |
| 847,474 | 3/1907 | Hawley . | |
| 1,073,565 | 9/1913 | Biehl | 30/321 |
| 1,750,577 | 3/1928 | De Bracht . | |
| 2,494,089 | 1/1950 | Guignabert | 30/258 |
| 4,095,337 | 6/1978 | Pharr | 30/158 |

FOREIGN PATENT DOCUMENTS

| | | | |
|---|---|---|---|
| 800283 | 10/1950 | Fed. Rep. of Germany | 30/158 |
| 33883 | 11/1910 | Sweden | 30/321 |
| 5613 | of 1892 | United Kingdom | 30/158 |

*Primary Examiner*—Douglas D. Watts
*Assistant Examiner*—Paul M. Heyrana, Sr.
*Attorney, Agent, or Firm*—Christie, Parker & Hale

[57] ABSTRACT

A thumb actuator for a folding knife. The thumb actuator comprises an elongated body with a recess therein for receiving the non-cutting edge of the knife blade, a set screw threadedly mounted to said body and protruding in said recess to lock the body on the blade, and a circular knurled head forming a thumb engaging surface.

11 Claims, 2 Drawing Sheets

THUMB ACTUATOR FOR FOLDING KNIFE

FIELD OF THE INVENTION

The invention relates to the general field of cutting tools such as folding knives and, more particularly, to an actuator therefor allowing to open the knife with one hand.

BACKGROUND OF THE INVENTION

Folding knives are extremely popular among sportsmen, members of the police force, firemen or other emergency service personnel whose duties may sometimes require the one-handed use of a cutting tool. The folding knife is particularly advantageous for such applications because it occupies a small amount of space in one's pocket and also it is totally safe to handle when in folded condition as the blade is securely stored in the handle.

A typical folding knife comprises a hollow handle and a blade retained to the handle by a pivot pin allowing the blade to move between a closed and an opened position. In the closed position, the cutting edge of the blade is securely received within the cavity in the handle, whereas in the opened position the blade is in axial alignment with the handle, the cutting edge of the blade being exposed. A spring loaded latch mechanism is provided in the handle to lock the blade in the opened position to prevent an accidental retraction thereof while the knife is being used. An actuator is provided on the handle to disengage the spring latch when it is desired to fold the knife.

In order to open the blade, it is known to provide a groove or notch near the non-cutting edge of the blade to be grasped by fingers to pivot the blade out of the handle. This arrangement requires two hands to open the blade which may constitute a disadvantage in a situation where one is holding an article to be cut with one hand, thereby leaving free only the other hand to open the knife.

To address this problem, various devices have been developed and commercialized in past years. One example is the so called switch blade knife which has a spring loaded blade that can be extended by depressing an actuator on the handle. Although this arrangement allows a one-hand operation, this type of knife is considered as an illegal weapon in most places.

Another example is the provision of a thumb actuator in the form of a pin secured near the non-cutting edge of the blade close to the pivot pin between the blade and the handle. Normally, the pin is mounted into a hole drilled in the blade. Although this system allows a one-hand operation, it is extremely difficult to install on an existing knife as the blade is made of a hardened material and is very difficult to drill. For this practical reason, thumb actuators of this type are installed only at the manufacturing stage of the knife, before the blade has been subjected to any hardening treatment. This also draws another disadvantage in that the manufacturer selects the location of the pin on the blade which may not necessarily suit the user preference.

A further example is the spring clip thumb actuator of the type described in the Pharr U.S. Pat. No. 4,095,337 which has been issued on June 20, 1978. This actuator comprises a resilient steel saddle tightly fitted over the non-cutting edge of the blade and a flat plate mounted to the saddle to be engaged by the thumb to open the blade. This arrangement has two disadvantages. Firstly, it cannot be used equally well by left and right handed individuals. Secondly, it lacks adjustability as it attaches well, only where the blade thickness exceeds by a slight amount the spacing of the resilient steel saddle.

OBJECTS AND STATEMENT OF THE INVENTION

An object of this invention is an improved actuator for the blade of a folding knife.

Another object of the invention is an actuator for the blade of a folding knife that can be used equally well by a left or right handed operator.

A further object of the invention is an improved actuator for the blade of a folding knife, adjustable in position on the blade.

Another object of the invention is an actuator for a folding blade which does not require any modification to the blade of the knife in order to be installed.

Yet another object of the invention is an improved actuator for the blade of a folding knife that allows for attachment to a relatively wide range of blade thicknesses.

The invention provides a finger actuator to be attached on the blade of a folding knife. The finger actuator has an elongated body with a recess in which fits the non-cutting edge of the blade. A screw threadedly mounted on the body protrudes in the recess and engages the blade in order to lock the finger actuator thereon. The finger actuator is provided with an elongated and curved finger engaging surface. Hereinafter, the term "curved" is intended to encompass not only an arcuate shape or a round shape such as circular or elliptic but also other shapes that locally may not have the characteristics of a curved line but in the overall, they resemble a curved line. Examples are pentagons, hexagons, or other parallelograms where the angle between two adjacent sides is obtuse. The invention also extends to a folding knife incorporating the thumb actuator.

In a preferred embodiment, the finger actuator has a circular knurled finger engaging head. The knurling is constituted by parallel score lines extending from the top edge of the head towards the blade and being inclined in the direction in which the blade opens, whereby the knurling guides the finger toward the blade for a more positive engagement reducing the possibility of slippage of the finger.

DESCRIPTION OF A PREFERRED EMBODIMENT

Figure 2:
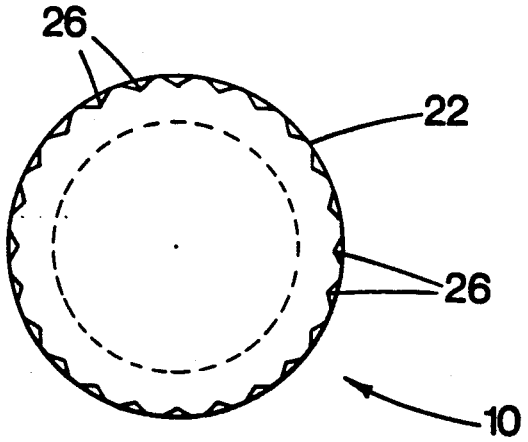
FIG. 2 is a top view of the finger actuator illustrated in FIG. 1.
Figure 1:
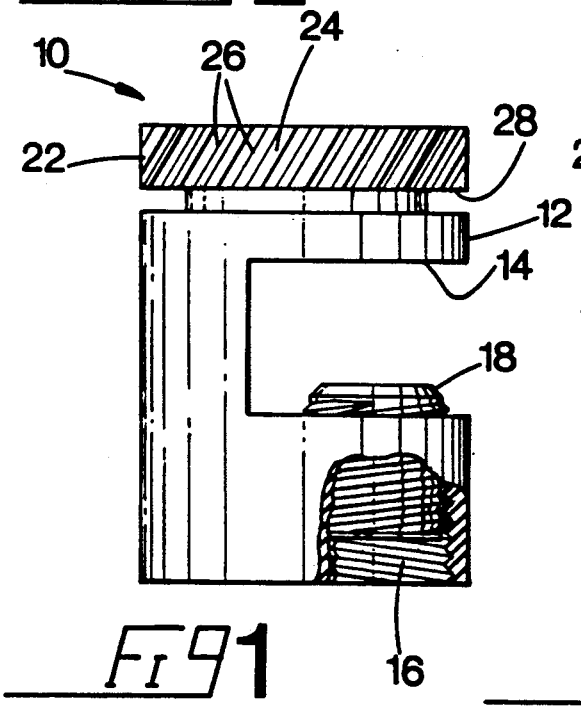
FIG. 1 is a side elevational view of the finger actuator in accordance with the invention.

The finger actuator 10 illustrated in FIGS. 1 to 5 comprises a generally cylindrical body 12 made of stainless steel or any other suitable material in which is machined a recess 14. A tapped bore 16 is provided below the recess 14, receiving a set screw 18 therein. The set screw 18 has at one end thereof a tool engaging cavity 20, the other end of the set screw 18 protruding within the cavity 14.

At the top end of the body 12 is mounted a disc-shaped head 22 that has a circular finger engaging surface 24. The finger engaging surface 24 is knurled by providing oblique and parallel score lines 26. The rounded head 22 is spaced from the remainder of the body 12 by a circumferential groove 28 which facilitates the machining of the knurl.

Figure 3:
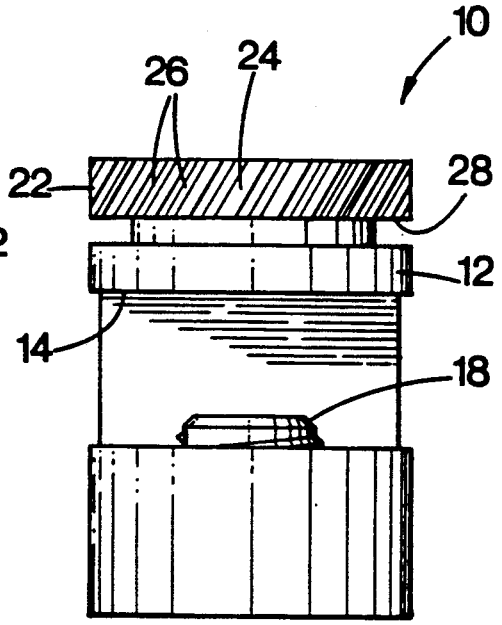
FIG. 3 is a front elevational view of the finger actuator in accordance with the invention.
Figure 4:
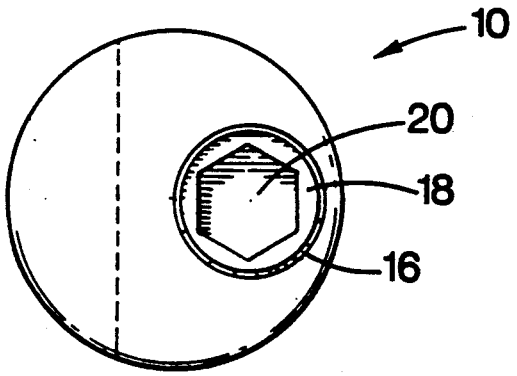
FIG. 4 is a bottom view of the finger actuator illustrated in FIG. 1.
Figure 5:
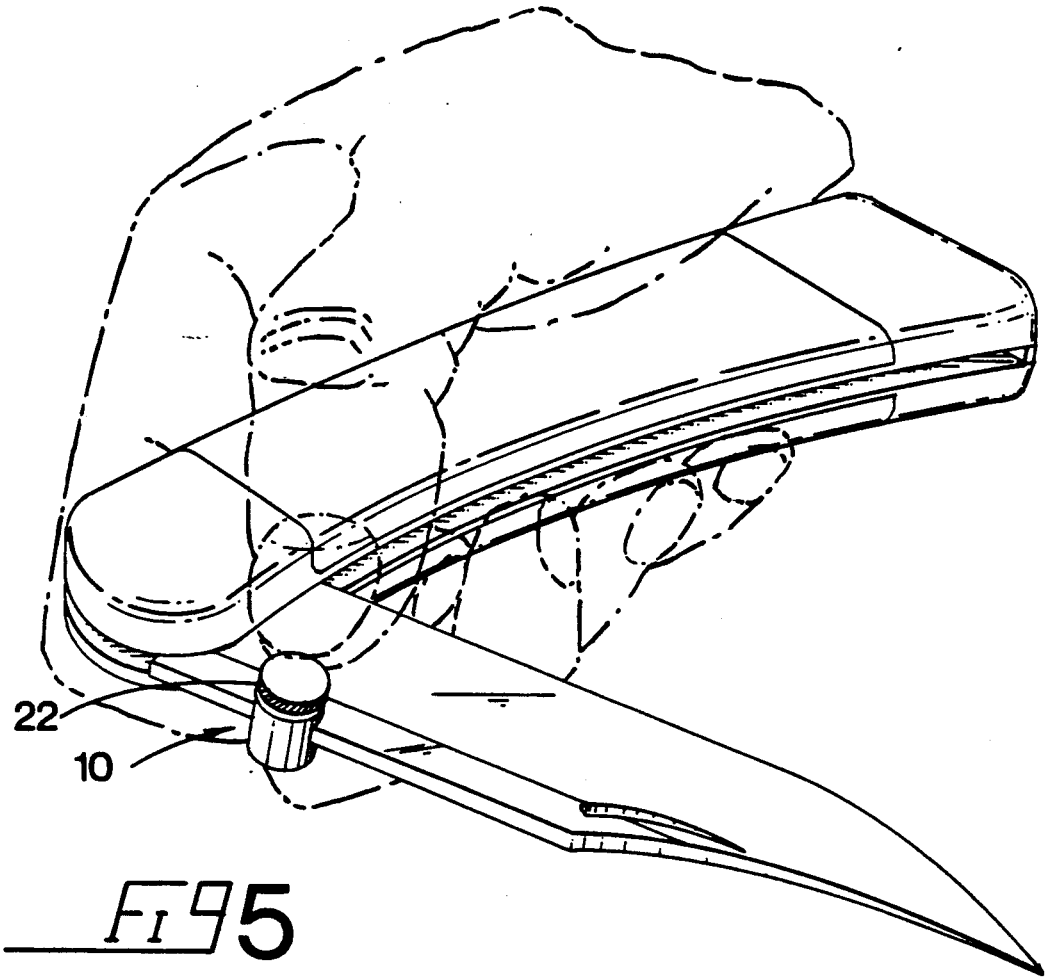
FIG. 5 is a perspective view of the finger actuator mounted to the blade of a folding knife shown operated to open the knife.

The installation of the finger actuator 10 on the folding knife and its operation thereof are best illustrated in FIG. 5. To install the finger actuator 10, the set screw 18 is retracted from the cavity 14 and the body 12 is mounted on the blade of the folding knife so that the non-cutting edge of the blade is received in the cavity 14. The orientation of the rounded head 22 with respect to the blade of the knife determines whether the finger actuator is set for a left or right handed operator. If the finger actuator 10 is mounted as illustrated in FIG. 3, this corresponds to a right handed operator. To set the finger actuator for a left handed operator, it suffices to invert it on the blade. This flexibility is an important advantage allowing use of the finger actuator equally well by a left or right handed operator.

When the finger actuator 10 has been located in the appropriate position, the set screw 18 is tightened to clamp the blade with the required force. It has been found that this attachment system is advantageous in that it is mechanically simple, can be used with various blade thicknesses and, at the same time, it allows to securely clamp the finger actuator on the blade without damaging the blade in any way. In addition, this attachment system allows to adjust precisely the position of the actuator relatively to the blade pivot pin, thus determining the leverage of the actuator.

In order to open the folding blade, it suffices to firmly hold the handle portion of the knife in the palm of the hand and to push on the finger actuator 10 with the thumb until the blade is locked into the opened position. It will be appreciated that as the blade progressively opens, the head 22 in a rolling contact with the thumb, follows an arc of circle and its position rotates under the thumb, however, due to the curved configuration of the finger engaging surface 24, the area of the rounded head in contact with the thumb remains generally constant for a wide range of blade angle positions.

The knurled finger engaging surface 24 provides a good frictional contact with the skin and therefore reduces the possibility of slippage. It has also been found that the orientation of the score lines which extend from the top edge of the rounded head 22 towards the recess 14 and are inclined in the direction in which the blade opens, as shown in FIG. 3, provides a more secure engagement because the score lines 26 somewhat guide the thumb downwardly, toward the blade where it is wedged between the head 22 and the blade surface.

When the blade is in the opened position, the actuator 10 forms a convenient thumb rest on which one may press when it is required to exert a force on the blade for cutting thick or hard material.

Modifications of the finger actuator 10 are possible. The set screw 18 may be made part of the rounded head 22. In this arrangement, the head 22 will form the head of the screw and will be used to tighten same to lock the finger actuator on the blade, without necessitating a tool.

In another variant, the finger actuator may be provided with a rounded knurled head at each extremity so that it can be used by both left and right handed individuals without necessitating to set the actuator into a specific position depending whether one is left or right-handed.

It should be understood that the above description of a preferred embodiment of this invention has been given only as an example and it should not be construed in a limiting manner since variations and refinements of this embodiment are possible without departing from the spirit of the invention. The scope of the invention is defined in the annexed claims.

I claim:

1. An attachment for a folding knife of the type comprising a blade pivotally mounted to a handle for movement between opened and closed positions, said attachment comprising:

a body;

a recess in said body for receiving therein an edge of said blade;

a screw threadedly engaged in said body capable of protruding in said recess for engaging said blade to lock said body to said blade; and a curved finger engaging surface on said body allowing said blade to pivot from said closed position to said open position with one hand by exerting finger pressure on said finger engaging surface while holding said handle.

2. An attachment as defined in claim 1, wherein said finger engaging surface comprises irregularities to enhance resistance to motion between a finger and said finger engaging surface.

3. An attachment as defined in claim 2, wherein said body comprises a rounded head spaced from said recess, said rounded head including a peripheral portion forming said finger engaging surface.

4. An attachment as defined in claim 3, wherein said peripheral portion is knurled.

5. An attachment as defined in claim 3, comprising a plurality of parallel score lines on said peripheral portion.

6. An attachment as defined in claim 5, wherein said score lines extend from a top extremity of said rounded head toward said recess, said score lines being inclined in a direction of movement of said blade from a closed position towards an opened position.

7. An attachment as defined in claim 3, wherein said rounded head is generally circular.

8. An attachment as defined in claim 7, wherein said body is generally cylindrical, further including a circumferential groove adjacent said rounded head.

9. A knife, comprising:

a handle;

a blade having cutting and non-cutting edges, said blade being pivotally mounted to said handle for movement between and opened and a closed position;

a thumb actuator for said blade, including:

(a) an elongated body;

(b) a recess in said body, said recess receiving the non-cutting edge of said blade;

(c) a screw threadedly engaged in said body, said screw protruding in said recess and engaging said blade for securing said body to said blade; and (d) a rounded head mounted to said body and spaced from said recess, said rounded head including a peripheral portion, said blade being movable from said closed to said opened position by exerting a pressure with a thumb on said round head while holding said handle in the hand to which said thumb belongs.

10. A knife as defined in claim 9, wherein said peripheral portion comprises irregularities to enhance resistance to motion between the thumb and said peripheral portion.

11. An attachment for a folding knife of the type comprising a blade pivotally mounted to a handle for movement between closed and opened positions, said attachment comprising:

a body;

a recess in said body for receiving therein a noncutting edge of said blade;

a set screw threadedly engaged in said body, capable of protruding in said recess for engaging said blade and locking said body to said blade; and a curved finger engaging surface on said body, finger pressure applied by the user on said surface causing a progressive blade movement toward said opened position through a rolling contact between said surface and a finger exerting pressure thereon.

* * * * *